United States Patent [19]

Volk

[11] 4,450,036

[45] May 22, 1984

[54] PORTABLE LABELING MACHINE

[75] Inventor: Heinrich Volk, Beerfelden-Gammelsbach, Fed. Rep. of Germany

[73] Assignee: Esselte Pendaflex Corporation, Garden City, N.Y.

[21] Appl. No.: 384,718

[22] Filed: Jun. 3, 1982

[30] Foreign Application Priority Data

Jul. 17, 1981 [CH] Switzerland ..... 4695/81

[51] Int. Cl.[3] ..... B65C 11/02

[52] U.S. Cl. ..... 156/384; 101/110; 101/288; 101/291; 156/577; 156/579; 156/DIG. 47; 156/DIG. 49

[58] Field of Search ..... 156/384, 577, 584, 579, 156/DIG. 49, DIG. 47; 101/288, 291, 292, 110, 111

[56] References Cited

U.S. PATENT DOCUMENTS

| | | | |
|---|---|---|---|
| 4,050,375 | 9/1977 | Orlens | 101/110 |
| 4,149,460 | 4/1979 | Sato | 101/288 |
| 4,155,302 | 5/1979 | Sato | 101/288 |
| 4,364,312 | 12/1982 | Sato | 101/110 |

*Primary Examiner*—Michael G. Wityshyn
*Attorney, Agent, or Firm*—Anthony J. Casella; Gerald E. Hespos

[57] ABSTRACT

The machine, which is equipped with a print head (5) which is movable vertically between two walls (25, 26) of its housing, comprises a device intended to prevent said motion, when the character selection rod (20) of said print head is left in its extended position.

The selection rod comprises an engagement element (23) for the engagement of a series of rotary elements (16, 17) which bear printing characters.

The safety device comprises a retractable movable stop (28) firmly connected to the print head (5) and subjected to the pressure of a spring (35), and a fixed counter-abutment (29) rigidly connected to a wall (26) of the housing.

At the end of the return stroke of the selection rod (20), the movable stop (28) is retracted by the push of said rod, whose engagement element (23) then develops a retaining force which is greater than the action of the spring (35).

4 Claims, 8 Drawing Figures

PORTABLE LABELING MACHINE

The object of the present invention is a portable labeling machine intended to print selected legends on self-adhesive labels and to attach the labels to articles intended for sale.

This machine comprises a housing extended by a handle with control lever and comprising at least a movable printhead connected to the lever, controlled thereby to imprint by stricking movements selected characters on self-adhesive labels supported by a continuous strip, and provided with a character selection shank having a control knob and movable around and along its revolution axis from a rest inward position up to an end of selection outward position, a selection stop bound to said shank to maintain it in engagement in a selected wheel of a plurality of coaxial wheels driving a plurality of continuous rotary members carrying printing characters, and a safety device adapted to prevent the striking movements of the printhead when the character selection shank is not completely in its rest inward position.

On the known machines of this type the operator may happen to forget to return the character-selection rod after having composed the selected legend which is to appear on the labels to be affixed to a given article. As a result, this rod together with its control button forms a relatively large protrusion with respect to the housing of the machine and this protrusion may constitute a disturbance during the labeling operation, for instance in confined or narrow spaces, and may be struck more or less forcefully against an obstacle. In such latter case, the impact may cause rotation of the control knob and alter the legend which was composed without the operator noticing this, or else even cause the breaking of the character-selection rod.

The safety devices which these machines have are intended in order to avoid these drawbacks by preventing any striking movement as a result of the actuation of the control lever, so as to compel the operator to make good his omission upon the very first operation. On one of these devices, the edge of the housing located on the same side as the knob of the selection rod is shaped so as to present a natural obstacle to said rod when it has been left in extracted position and thus prevent any movement of the print head. On another known safety device, the selection rod has, behind its control knob, a decrease in diameter which permits its passage, in retracted position, along an opening of equivalent width provided in the wall of the housing during the striking movement of the print head; when the selection rod is left in extended position it is its part of larger diameter which cannot pass through this opening which is present in front of it, this prohibiting any movement of the print head.

These two safety devices achieve the desired purpose but nevertheless have the drawback of bringing onto on overhung portion of the selection rod the striking force of the print head since this rod serves as element for the blocking of its movement. In case of a sudden force this part, which is by nature fragile, may be twisted or broken.

A safety device has also been proposed in which especially adapted for labeling machines with rotary print head, in which the character selection rod, which is arranged in radial position, is automatically retracted in case it is left in its extended position, during the movement of rotation of the print head which precedes the impact by means of an inclined wall which is arranged on its path and acts as a cam. This device makes it possible, to a certain extent, to limit the forces suffered by the character-selection rod but it cannot be used on machines with rocking or reciprocating print heads in which the character selection rod protrudes laterally from the housing of the machine without raising problems of reliability, in particular when the stroke of the print head is definitely shorter, at the level of the character selection rod, than the axial stroke of the latter from its extracted selection position to its retracted end-of-selection position.

The object of the invention is to avoid these drawbacks and to permit its application to all types of portable labeling machines of the kind described at the beginning hereof.

For this purpose, the portable labeling machine of the invention is characterized in that the safety device is formed of a retractable movable abutment which is independent from the character selection shank and of a steady counter-abutment located on the active trajectory of the movable abutment substantially at its level in the rest position of the printhead, in that one of these two members is fastened to the printhead and the other to the housing, in that the retractable movable abutment is on the one hand permanently biased by a spring capable of causing its active exit and on the other hand subjected to the antagonist thrust of an urging member bound to the character selection shank to cause its retraction at the end of the inward stroke of said shank, and in that the bias of the spring is lower than the retaining force of the selection stop associated to said shank.

Therefore, when the operator leaves the character selection rod in extended position, the movable stop, freed from the priority thrust of this rod, is brought into active position by the action of the spring and is opposite the abutment, the latter preventing any movement of the print head from its position of rest. The blocking is thus assured by a member which is independent of the character selection rod, thus freeing the latter from any stresses due to the striking force. The component members of the safety device, namely the movable stop and the stationary stop, are easily installed on all types of labeling machines with movable print head, whether reciprocating, tilting or rotating, this installation being independent of the type of movement applied as well as the orientation of the character selection rod with respect to the housing of the machine.

The accompanying drawing shows, by way of example, one embodiment of the object of the invention as well as two variants of the device which characterizes it.

Figure 1:
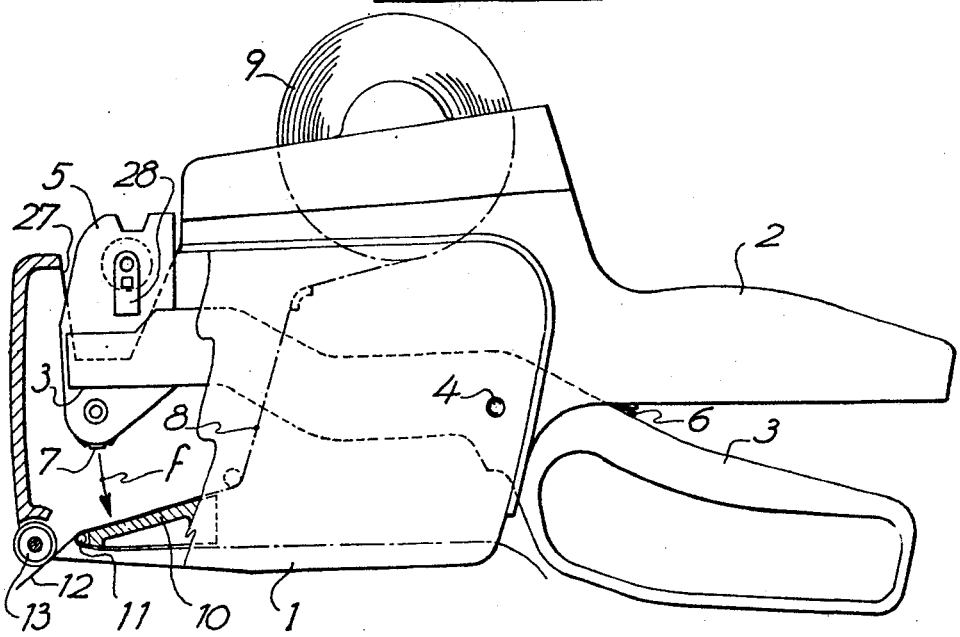
FIG. 1 is an overall view of the embodiment, in elevation and partially in section.

The portable labeling machine shown in FIGS. 1 to 4 comprises a housing 1 extended by a handle 2 with control lever 3 articulated on a pivot 4 and connected to a movable print head 5. The lever/print head assembly is held in position of rest, as shown in FIG. 1, by a spring 6, partially visable, located between the handle 2 and the control lever 3.

The actuating of the lever 3 causes the lowering of the print head 5 along a path having the shape of a circular arc, indicated by the arrow f, and the striking of selected printing characters 7 on a self-adhesive label borne by a continuous strip 8 coming from a roll 9 and the path of which passes over a stationary print table 10 which is rigidly connected to the housing 1. A step-by-step drive device, not shown, located below the inner part of the lever 3, is connected to the latter so as to advance the continuous strip 8, upon each actuation of said lever, in traditional fashion by one step corresponding to one length of label.

The print table 10 has a tear edge 11 at the level of which each printed label 12 is separated by its own rigidity from the continuous strip 8, the path of which has at this point a hairpin-shaped contour, and comes below a pressing roller 13 intended to permit the gluing thereof by pressure to the object to be labeled.

Figures 2, 3, 4:
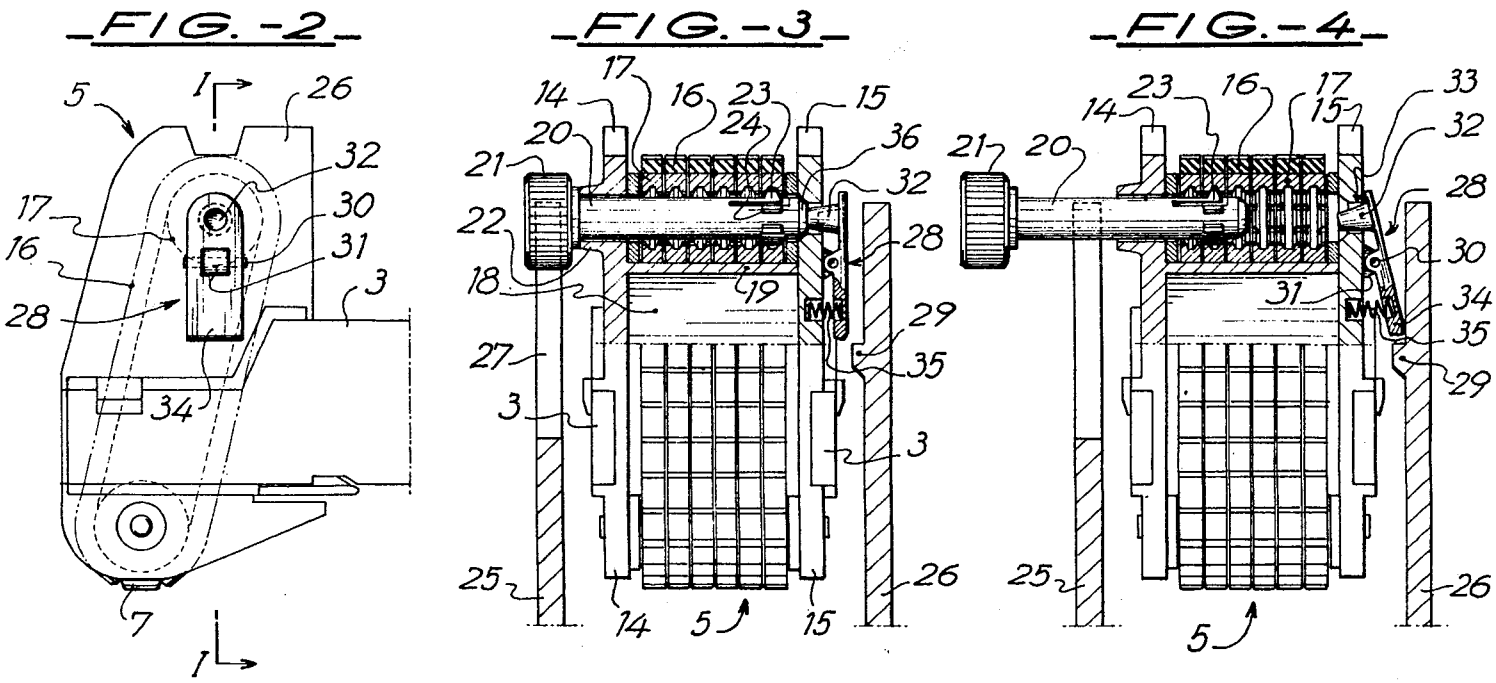
FIG. 2 is a detailed view in elevation on a larger scale showing the device which characterizes it.
FIGS. 3 and 4 are two partial sections through FIG. 2 along the axis I—I, shown in two different configurations.

The print head 5, which is shown on a larger scale in detail in FIGS. 2, 3 and 4 has, held between two sidewalls 14 and 15, a plurality of continuous rotary elements which bear printing characters, consisting here of six belts 16 extending around two spaced series of coaxial wheels 17, only the upper series of which is shown, which are held resting elastically, by the tension of these belts, in two spaced cylindrical sectors connected to each other by a wall 18 only the upper one 19 of which is shown in section in FIGS. 3 and 4.

This print head has a character selection rod 20 with control knob 21 movable around and along its axis of revolution in an elongated bearing 22 borne by the sidewall 14. This selection rod is coaxial with the series of upper coaxial wheels 17 and has an axial engagement element 23 as well as elements 24 for the driving and rotation of these wheels in traditional manner.

The two sidewalls 25 and 26 of the housing of the machine are also shown in FIGS. 3 and 4, the wall 25, located on the same side as the control knob 21, having a notch 27, visible also in FIG. 1, which is entended to permit the free passage of said selection rod during the lowering of the print head which causes the striking of the characters.

The character selection rod 20 is shown in FIG. 3 in retracted position of rest and in FIG. 4 in practically completely extended end-of-selection position, this latter position being one of those which cause the problems mentioned above and which are inherent in the protrusion which the rod represents on the sidewall 25 of the housing.

In order to prevent any lowering of the print head 5, which would cause the striking of characters in this latter position as well as in all other totally or partially emerged positions of the character selection rod 20, this machine has a safety device which is composed of a retractable movable stop 28 rigidly attached to the print head 5, independent from selection rod 20, and of a stationary counter-abutment 29, which is rigidly attached to the sidewall 26 of the housing of the machine.

The retractable movable stop 28 is formed in this case of a rocker which is articulated at its central portion on a pivot 30, borne by a bracket 31 protruding from the sidewall 15 of the print head. This rocker is provided, at the end of one of its two arms, in this case the upper one, with a stud 32 which is located substantially in the axis of the selection rod 20 and engages in a hole 33 of the wall 15 opening into the inside of the coaxial wheels 17 opposite the wall 14 located on the same side as the control knob 21. The lower arm 34 of this rocker, which constitutes the stop proper, has a recess in which there is engaged a compression spring 35 held between this lower arm and the wall 15 in which this spring is also engaged, resting in a recess. The thrust developed by this spring 35 must be less than the retaining force of the engagement element 23 of the character selection rod 20. The protrusion of the stud 32 into the hole 33 in the wall 15 must be sufficient that, at the end of the return stroke of the selection rod 20 corresponding to its position of rest shown in FIG. 3, the end 36 of the rod comes against this stud so as to cause the retraction of said movable stop 28 with respect to the counterabutment 29 by a thrust in opposition to that of the spring 35.

The stationary abutment 29 is arranged in the active path of the movable stop 28, that is to say the latter, considered in extended position as shown in FIG. 4, and substantially at its level in raised position of rest of the print head 5, so that these two members encounter each other at the very start of the striking movement of the print head 5 caused by the actuating of the control lever 3.

This embodiment of the safety device is adapted for labeling machines whose print head permits the actuating of the retractable movable stop by the end of the selection rod opposite the control button 21, that is to say when a contact element such as the stud 32 may debouch opposite said end.

Figure 5:
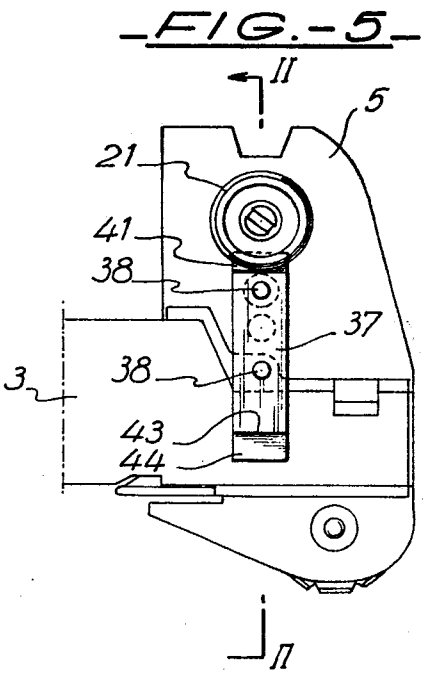
FIG. 5 is a view in elevation of the device which characterizes the first embodiment.
Figure 6:
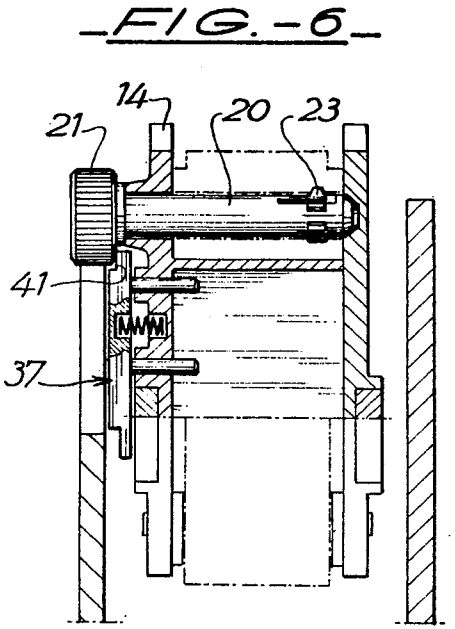
FIG. 6 and 7 are two partial sections through FIG. 5 along the lines II—II shown in two different configurations.
Figure 7:
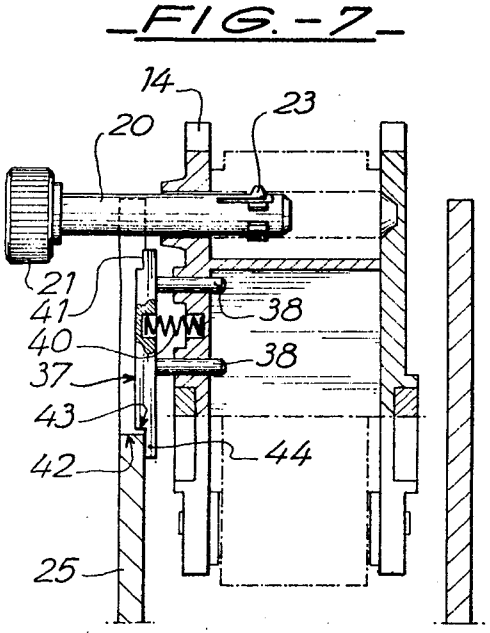

Otherwise, the first variant shown in FIGS. 5, 6 and 7 will be preferred, for which, however, the same print head 5 has been shown with the same reference numbers in order to simplify the description.

In this first variant, the retractable movable stop consists of a push member 37 having two spaced guide rods 38 parallel to the character selection rod 20, which guide rods are engaged and intended for translation in two bearings of the wall 14 of the print head 5. This movable stop is located this time on the same side as the control button 21 for the selection rod 20.

This push member 37 is subjected to the thrust of a spring 40 held between it and the wall 14 between the two guide rods 38 and has the shape of an arm extending from the rear face of the control knob 21, at the level of which it has a first resting face 41, down to the upper edge 42 of the side wall 25 of the housing 1 of the machine, at the level of which it has a stop-forming face 43 proper and a second resting face 44. In this first variant, the edge 42 of the housing constitutes the stationary abutment.

In retracted position of rest of the selection rod 20, shown in FIG. 6, the push member 37 is retracted by a translation caused by the push of the control knob 21 on its first resting face 41 and is held in this position by the retention of the engagement element 23, as in the preceding example.

In the extended position of the selection rod 20, shown in FIG. 7, the push member 37 is freed and subjected to the action of the spring 40, which has the effect of placing its second resting face 44 in contact with the inner face of the wall 25 of the housing and its stop 43 proper opposite the counter-abutment 42, thus preventing any movement of the print head 5.

Figure 8:
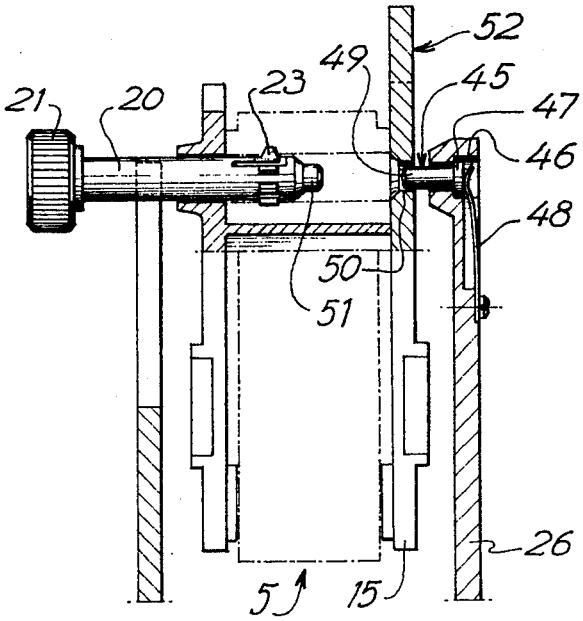
FIG. 8 is a view in elevation of the device which characterizes the second variant.

The second variant of the safety device shown in FIG. 8 makes it possible to avoid the installing of a movable member, such as the retractable stop, on the print head and can be applied when such installation presents problems as to space available. This variant is applicable only to machines whose print head permits the actuation of the retractable stop by the end of the selection rod opposite the control knob, as in the first example.

In this second variant, the retractable movable stop consists of a cylindrical push member 45 located substantially in the axis of the character selection rod 20 in raised position of rest of the print head 5 within a cylindrical recess 46 of the side wall 26 of the housing of the machine, this push member having a retention shoulder 47 which is subjected to the thrust of a spring blade 48 fastened to said wall, this thrust being here also less than the retaining force of the engagement element 23 of the selection rod.

The active end 49 of this push member, rounded in the shape of a hemisphere, is engaged in a hole 50 in the wall 15 of the print head 5 debouching opposite the end of the selection rod and opposite its control knob 21, when the said selection rod is in extended position as shown in this FIG. 8. This end of the selection rod has a stud-shaped extension 51 intended to push the push member 45 back at the end of the return stroke of the selection rod so as to cause the retraction of said push member out of the hole 50 by a translation of a thrust opposite that of the spring 48. During the striking stroke of the print head 5, this push member 45 is held in retracted position by a retaining ramp 52 forming an extension of the wall 15 and flush with the orifice of the hole 50 which here serves as stationary counterabutment, over which ramp the rounded end 49 of this push member slides.

Of course, the invention is applicable to portable labeling machines having more than one print head for printing more than one line of characters. In such cases, a retaining device will be associated with each selection rod of the print heads.

Other variants in addition to those shown which constitute equivalents, may be applied.

Hence, for example, the rocker 28 of the embodiment shown on FIGS. 2, 3 and 4 may be articulated inside the print head 5, on the other face of wall 15, only its lower end 34 forming abutment being set aside towards the outside through an opening of said wall. This variant may be applied when the selection shank 20 is associated to a parallel index located thereabove and when this shank cannot exit through an axial hole towards the outside. In this case, the rocker comprises an annular part surrounding the selection shank in order to permit the setting aside of the stud 32 towards the up to place it at the level of the index and have it controlled thereby. Finally, the invention is also applicable to labeling machines in which the engagement element (23) is not on the character selection shank but on an element bound to said shank, such as for instance the aforesaid index.

What is claimed is:

1. A portable labeling machine having a housing extended by a handle with control lever and comprising at least a movable printhead driven by the control lever to imprint by striking movements selected characters on self-adhesive labels supported by a continuous strip, said printhead being provided with a character selection shank rotatively and axially movable along its longitudinal axis from a rest inward position up to outward selection positions and with stop means for maintaining said character selection shank in any one of said positions, and a safety device adapted to prevent the striking movements of the printhead when the character selection shank is not completely in its rest inward position, which safety device comprises a retractable movable abutment and a stationary counter-abutment, said retractable movable abutment having a protruding position in which it engages said counter-abutment in the rest position of the printhead to prevent the striking movements of the printhead and a retracted position in which said retractable movable abutment does not engage said counter-abutment and does not prevent the striking movements of the printhead, wherein one of said retractable movable abutment and stationary counter-abutment is mounted on the printhead and the other is mounted on the housing, spring means in contact with said retractable movable abutment to permanently bias said retractable movable abutment to urge it into the protruding position, wherein an antagonist thrust member is axially bound to the character selection shank to urge said retractable movable abutment into retracted position at the end of the inward stroke of said character selection shank, and wherein the bias of said spring means is lower than the retaining force of the stop means acting on said character selection shank.

2. A portable labeling machine according to claim 1, wherein the retractable movable abutment comprises a two arm rocker articulated on the printhead and having at the end of one of its two arms a stud located substantially opposite to and in the axis of the character selection shank, the other arm of said rocker forming an abutment proper and being subjected to the action of said spring means and wherein said retractable movable abutment is retracted by a tilting caused by the character selection shank coming against said stud.

3. A portable labeling machine according to claim 1, in which the character selection shank is provided with a control knob, wherein the retractable movable abutment comprises a push member connected to the printhead, which push member is in the form of an arm perpendicular to the character selection shank and movable by translation parallel to said character selection shank, said arm having a first rest surface located at the level of the control knob of said character selection shank and a second rest surface spaced from the first rest surface and forming an abutment proper, wherein this push member is subjected to the action of the spring means, and wherein said retractable movable abutment is retracted by a translation caused by the control knob of the character selection shank coming against said first rest surface.

4. A portable labeling machine according to claim 1, wherein the retractable movable abutment comprises a push member located substantially in the axis of the character selection shank in position of rest of the printhead, said push member being mounted within a recess in the housing of the machine, movable by translation in said recess and subjected to the action of the spring means, wherein the counter-abutment is formed of a hole in a wall of the printhead debouching opposite the character selection shank, wherein said wall is extended by a guide ramp flush with said hole, and wherein this retractable movable abutment is retracted by an end of the character selection shank coming against said push member and expelling said push member from said hole, this retraction being maintained during the striking movements of the printhead by said guide ramp.

* * * * *